US007900470B2

(12) United States Patent
Rafalovich et al.

(10) Patent No.: US 7,900,470 B2
(45) Date of Patent: Mar. 8, 2011

(54) AUTOMATIC ICEMAKER

(75) Inventors: Alexander Pinkus Rafalovich, Louisville, KY (US); Chandra Mohan Pendyala, Louisville, KY (US)

(73) Assignee: General Electric Company, Schenectady, NY (US)

( * ) Notice: Subject to any disclaimer, the term of this patent is extended or adjusted under 35 U.S.C. 154(b) by 632 days.

(21) Appl. No.: 11/952,389

(22) Filed: Dec. 7, 2007

(65) Prior Publication Data

US 2009/0145156 A1 Jun. 11, 2009

(51) Int. Cl.
*F25C 5/08* (2006.01)

(52) U.S. Cl. ..... 62/351; 62/353

(58) Field of Classification Search ..... 62/340, 62/347, 351, 353, 354, 344
See application file for complete search history.

(56) References Cited

U.S. PATENT DOCUMENTS

| | | | | |
|---|---|---|---|---|
| 2,799,144 | A * | 7/1957 | Barton | 62/137 |
| 4,429,550 | A | 2/1984 | Latter | |
| 4,838,026 | A | 6/1989 | Searl | |
| 4,896,513 | A * | 1/1990 | Troscinski | 62/351 |
| 4,923,494 | A * | 5/1990 | Karlovits | 62/73 |
| 6,438,976 | B2 | 8/2002 | Shapiro et al. | |
| 6,574,974 | B1 | 6/2003 | Herzog et al. | |
| 7,017,364 | B2 * | 3/2006 | Lee et al. | 62/351 |
| 2005/0115266 | A1 | 6/2005 | Lim et al. | |
| 2006/0016209 | A1 | 1/2006 | Cole et al. | |
| 2006/0086135 | A1 * | 4/2006 | Wu et al. | 62/351 |

* cited by examiner

*Primary Examiner* — Frantz F Jules
*Assistant Examiner* — Lukas Baldridge
(74) *Attorney, Agent, or Firm* — Fay Sharpe LLP

(57) ABSTRACT

An icemaker includes a body including an ice mode for receiving water and freezing water to ice. The ice mold has a first side surface, a second side surface and an arcuate bottom surface indisposed between the first side surface and the second side surface. An ice ejector including an ejector member is rotatably connected to the body. The ice ejector defines an axis of rotation. A drive mechanism is operably coupled to the ice ejector. The drive mechanism is configured to reversibly rotate the ice ejector between a first position and a second position. A first cover is fixedly connected to the body for at least partially covering a front portion of the ice mold. A second cover is connected to one of the ice ejector and the body. The second cover is configured to reversibly rotate with the ice ejector between the first position and a third position. The second cover at least partially covers a back portion of the ice mold at the first position. The first and second covers prevent water slosh in the ice mold and buildup of frost on the surfaces.

21 Claims, 8 Drawing Sheets

AUTOMATIC ICEMAKER

BACKGROUND

The present disclosure generally relates to an improved automatic icemaker for a refrigerator.

A conventional automatic icemaker assembly in a residential refrigerator has three major subsystems: an icemaker, a bucket with an auger and ice crusher, and a dispenser insert in the freezer door that allows the ice to be delivered from the bucket to a cup without opening the door.

With reference to FIGS. 1 and 2, a typical icemaker 10 located in a freezer compartment of the refrigerator includes a metal mold 12 that makes between six to ten ice cubes at a time. The mold is filled with water at one end and the water evenly fills a plurality of ice cube sections or compartments 20 through weirs 22 (shallow parts of dividers 24 between each cube section) that connect the sections. A fixed cover 26 is connected to the metal mold and is disposed over a front portion 28 of the mold. Opening a valve on a water supply line for a predetermined period of time usually controls the amount of water flowing into the metal mold 12. The temperature in the freezer compartment is usually between about −10F and +10F The metal mold 12 is cooled by conduction with the freezer air, and the rate of cooling can be enhanced by convection of the freezer air, especially when an evaporator fan is operating. A temperature-sensing device in thermal contact with the metal mold 12 can generate temperature signals. A controller 30 monitoring the temperature signals indicates when the ice is ready to be removed from the mold.

When the ice cubes are ready for removal, a motor, which is generally housed within the controller, drives a rake 32 in an angular motion. The rake includes a plurality of spaced projections 34, one projection for each cube section 20. The rake rotates in a single direction (see FIG. 2) and pushes against the cubes to force them out of a back uncovered portion 40 of the metal mold 12. The rake continues to rotate until the rake projections pass through spaced openings 42 located on the fixed cover 26. A heater 50 is typically provided on a bottom portion of the mold 12 to melt an interface between the ice and the mold. When the interface is sufficiently melted, the rake is able to push the cubes out of the mold. Because the rake pivots on a central axis, the cross-sectional shape of the mold typically is an arc of a circle to allow the ice to be pushed out.

As indicated above, the back portion 40 of the metal mold 12 is not covered, which can allow slosh in the mold. Further, because the projections of the rake rotate through the opening of the fixed cover, a clearance between the projections and opening is provided. This clearance can also allow sloshing of water in the mold. Further, if the icemaker is located in a fresh food compartment of the refrigerator, the icemaker can be exposed to air moisture thereby causing a buildup of frost on the metal mold 12. Thus a need exists for an icemaker that prevents water slosh and frost buildup on the ice mold.

BRIEF DESCRIPTION

In accordance with one aspect, an icemaker comprises a body including an ice mode for receiving water and freezing water to ice. The ice mold has a first side surface, a second side surface and an arcuate bottom surface indisposed between the first side surface and the second side surface. An ice ejector including an ejector member is rotatably connected to the body. The ice ejector defines an axis of rotation. A drive mechanism is operably coupled to the ice ejector. The drive mechanism is configured to reversibly rotate the ice ejector between a first position and a second position. A first cover is fixedly connected to the body for at least partially covering a front portion of the ice mold. A second cover is connected to one of the ice ejector and the body. The second cover is configured to reversibly rotate with the ice ejector between the first position and a third position. The second cover at least partially covers a back portion of the ice mold at the first position. The first and second covers prevent water slosh, water evaporation and ice sublimation in the ice mold and buildup of frost on the ice mold surfaces.

In accordance with another aspect, an icemaker comprises an ice tray including an ice forming compartment for receiving water and freezing the water to ice. A first cover is fixedly connected to the ice tray and is at least partially disposed over a first portion of the ice forming compartment. An ice ejector including an injecting member is rotatable relative to the ice tray from a closed firs position to a second ice harvesting position and back to the closed position. A second cover is connected to one of the ice ejector and the ice tray and is configured to at least partially rotate with the ice ejector from the closed position to a third position and back to the closed position. Rotation of the ice ejector causes the ejector member to advance into the ice forming compartment whereby ice located in the compartment is urged in an ejection path movement out of the compartment.

In accordance with yet another aspect, an icemaker comprises an ice tray including a plurality of ice forming compartments for receiving water and freezing the water ice. A fixed cover is connected to the ice tray and is at least partially disposed over a front portion of the plurality of ice forming compartments. An ice ejector is movably connected to the ice tray and includes an axle and a plurality of spaced projections located in a common plane tangent to the axle. There is one projection for each ice forming compartment. A moving cover is connected to the ice ejector. A drive mechanism is operably coupled to the ice ejector and is configured to reversibly rotate the ice ejector between a closed position and an ice harvesting position. Rotation of the ice ejector causes the plurality of projections to advance into the plurality of ice forming compartments whereby ice located in the plurality of compartments is urged in an arcuate ejection path of movement out of the plurality of compartments. Movement of the ice causes the moving cover to rotate about the axle of the ice ejector. As the ice moves out of the plurality of compartments, the ice ejector engages the moving cover whereby the moving cover rotates with the ice ejector to a third position. At the third position, the ice ejector disengages the moving cover and continues to rotate to the ice harvesting position.

DETAILED DESCRIPTION

Figure 2:
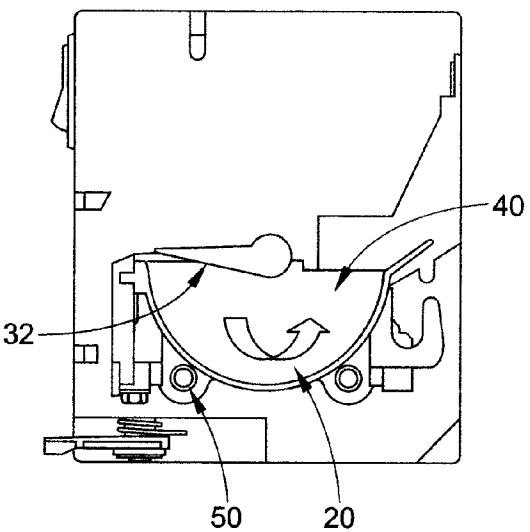
FIG. 2 is a side elevational view of the icemaker of FIG. 1.
Figure 1:
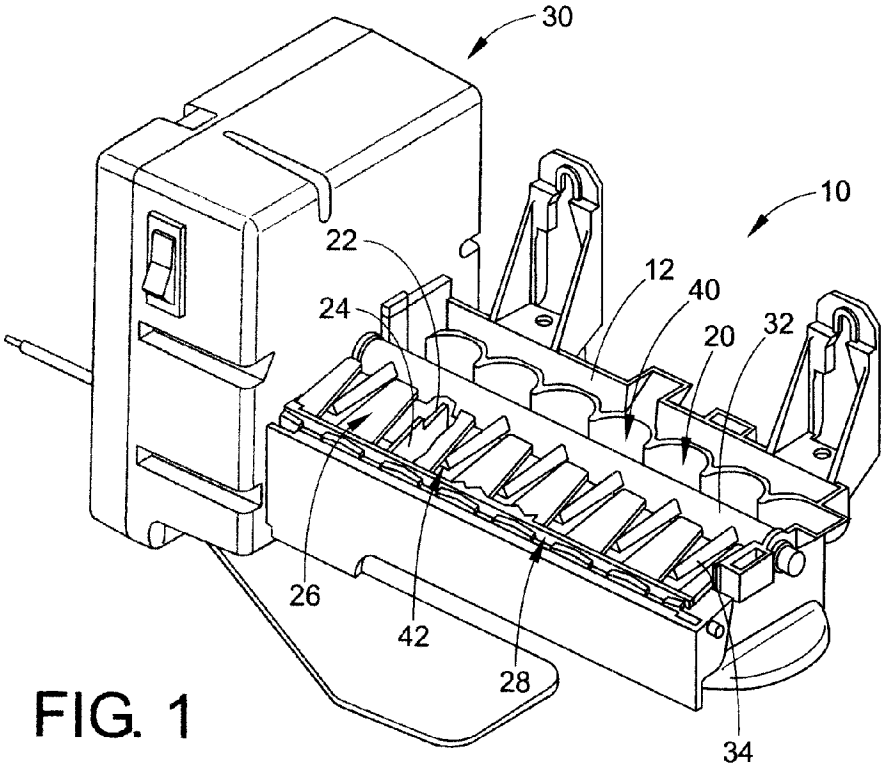
FIG. 1 is a side perspective view of a conventional automatic icemaker.
Figure 4:
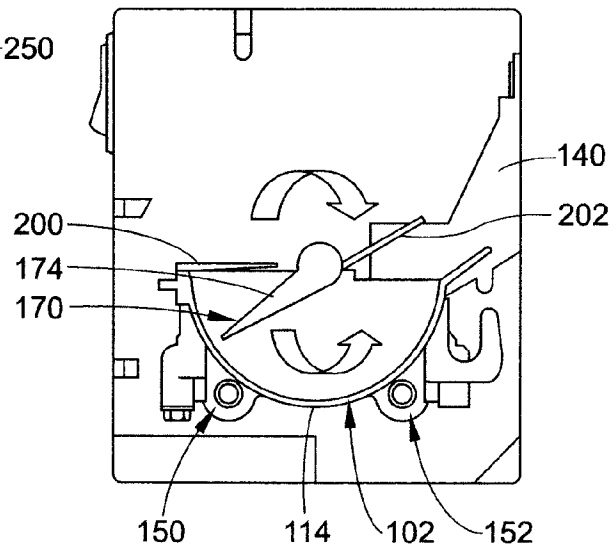
FIG. 4 is a side elevational view of the icemaker of FIG. 3.
Figure 3:
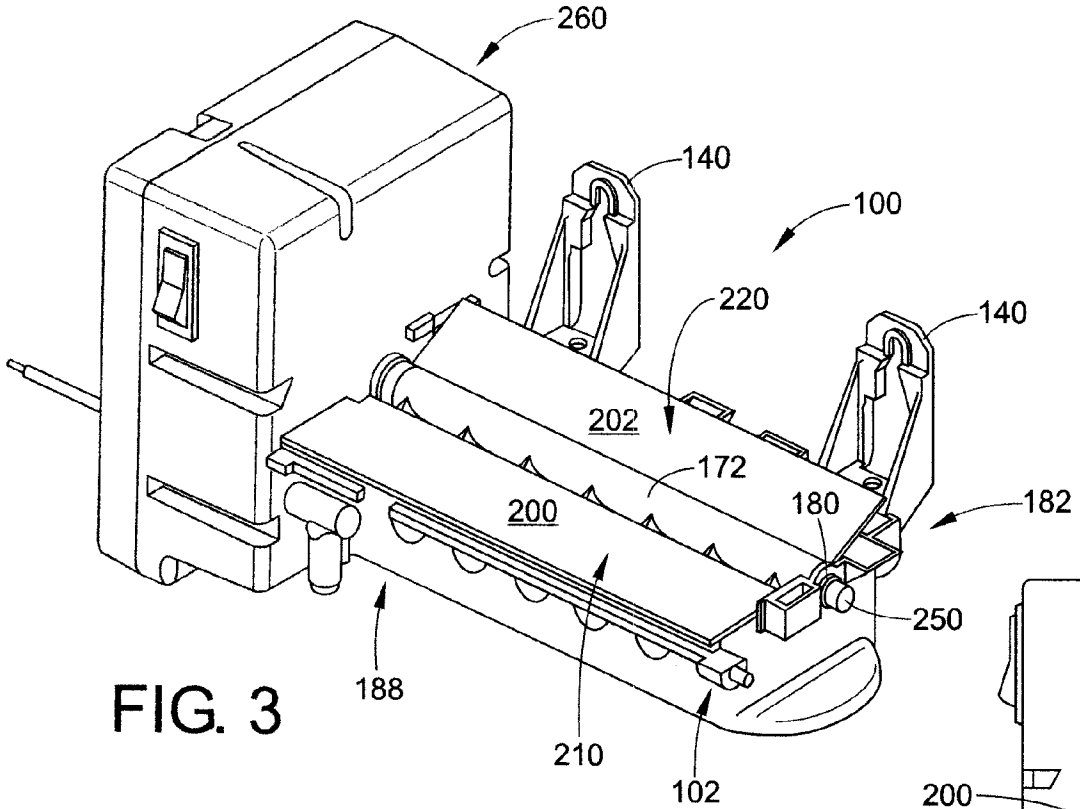
FIG. 3 is a side perspective view of an automatic icemaker according to the present disclosure.
Figure 5:
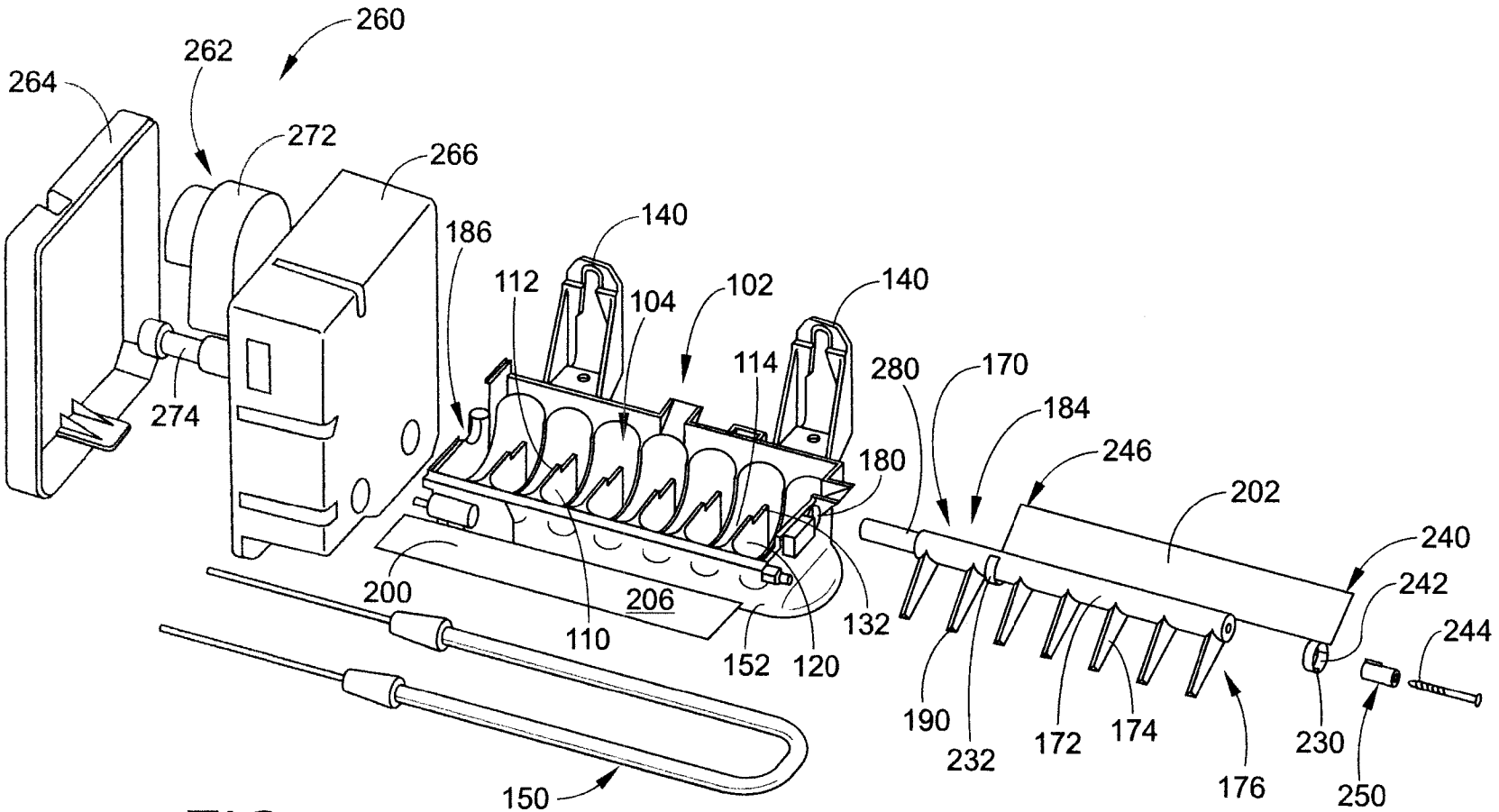
FIG. 5 is an exploded perspective view of the icemaker of FIG. 3.

Referring now to the drawings, wherein like numerals refer to like parts throughout the several views, FIGS. 3-5 illustrate an icemaker 100 for a refrigerator (not shown) according to the present disclosure. The icemaker 100 comprises a body or ice tray 102 including an ice mold or ice forming compartment 104 for receiving water and freezing the water to ice. As shown, the ice tray 102 includes seven substantially identical ice forming compartments; although, it should be appreciated that more or less than seven ice forming compartments can be provided. Each ice forming compartment 104 includes a first side surface 110, a second side surface 112, and an arcuate bottom surface 114 interposed between the first side surface and the second side surface. Partition walls 120 are disposed between each of the compartments, the partitions walls at least partially defining the first side surface and second side surface. The partition walls 120 extend transversely across the ice tray 102 to define the ice forming compartments 104 in which ice pieces 130 (see FIG. 7) are formed. Each partition 120 wall includes a recessed upper edge portion 132 through which water flows successively through each ice forming compartment 104 to fill the ice tray 102 with water. Mounting brackets 140 are provided on the ice tray for mounting the icemaker 100 within a freezer compartment (not shown) of the refrigerator. It is within the scope of the disclosure for other mounting features to be present on the ice tray and for those mounting features to facilitate mounting of the icemaker into other structures within the refrigerator. A water filling operation of the ice tray may be based on a set time.

As shown in FIG. 5, a sheathed electrical resistance heating element or heater 150 is mounted to a lower portion 152 of the ice tray 102. The heater can be press-fit, stacked, and/or clamped into the lower portion of the ice tray. The heater is configured to heat the ice mold when a harvest cycle is executed to slightly melt the ice 130 and release the ice from the ice forming compartments 104.

An ice ejector or rake 170 is rotatably connected to the ice tray 102. The ice ejector includes an axle or shaft 172 and a plurality of ejector members 174 located in a common plane tangent to the axle, one ejector member 174 for each ice forming compartment 104. The axle is concentric about the longitudinal axis of rotation of the ice ejector. To rotatably mount the ice ejector to the ice tray, a first end section 176 of the ice ejector is positioned adjacent an opening 180 located a first end portion 182 of the ice tray. A second end section 184 of the ice ejector is positioned in an arcuate recess 186 located on a second end portion 188 of the ice tray. In the illustrated embodiment, the ejector members 174 are triangular shaped projections 190 and are configured to extend from the axle 172 into the ice forming compartments 104 when the ice ejector is rotated. It is within the scope of the present disclosure for the ejector members to be fingers, shafts or other structures extending radially beyond the outer walls of the axle. The ice ejector 170 is rotatably relative to the ice tray from a closed first position (FIG. 7) to a second ice harvesting position (FIG. 15) and back to the closed position. Rotation of the ice ejector causes the ejector members 174 to advance into the ice forming compartment 104 whereby ice 130 located in each ice forming compartment is urged in an ejection path of movement out of the ice forming compartment.

Figure 6:
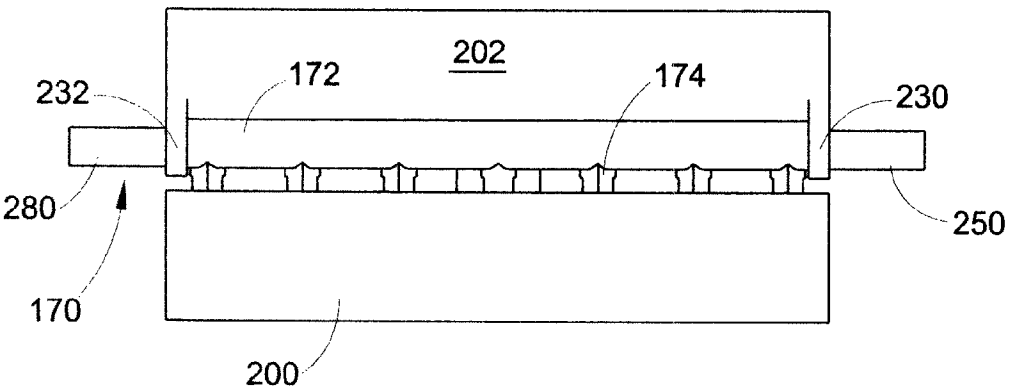
FIG. 6 is a partial top plan view of a first cover, a second cover and an ice ejector of the icemaker of FIG. 3.

With reference again to FIGS. 3 and 5, and with additional reference to FIG. 6, the icemaker 100 includes a first cover 200 and a second cover 202. The covers are configured to prevent sloshing of water, water evaporation and ice sublimation and the buildup of frost within the ice tray 102. The first cover is fixedly secured to the ice tray 102 and includes a generally rectilinear top surface 206 which is disposed at least partially longitudinally over a front portion 210 of the ice forming compartments 104. The first cover 200 can be secured to the ice tray 102 in any suitable manner, such as by screws.

Figure 12:
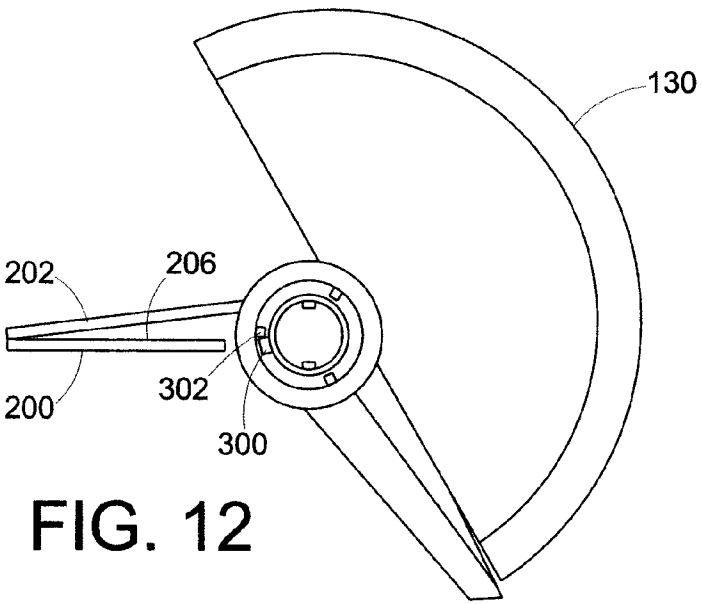

The second cover 202 is moveably connected to the ice ejector 170 for rotation therewith. As will be described in greater detail below, the second cover is configured to reversibly rotate with the ice ejector between the first closed position and a third position (FIG. 12). As shown in FIG. 3, the second cover 202 at least partially covers a back portion 220 of the ice tray 102 at the first position. To rotatably mount the second cover to the ice ejector, the second cover includes a circular flange 230 and an arcuate tab 232. The circular flange extends from a first end section 240 of the second cover and includes an opening 242 dimensioned to receive a cam 250. The cam is inserted through the opening 180 of the ice tray, and is releasably secured to the first end section 176 of the ice ejector by any suitable manner, such as the illustrated screw 244. The cam releasably attaches the second cover to the ice ejector. The arcuate tab 232 extends from a second end section 246 of the second cover and is dimensioned to engage the axle 172. It should be appreciated that alternative manners for rotatably connecting the second cover to the ice ejector are contemplated. As will be discussed in greater detail below, as the ice ejector 170 reversibly rotates between the first position and the second position, the cam 250 mounted to the ice ejector for rotation therewith is configured to engage the second cover 202 during rotation of the ice ejector 170 to the second position and disengage the second cover as the second cover approaches the third position and/or reaches the third position.

Cyclical operation of the heater 150 and the ice ejector 170 are effected by a controller 260 disposed on the second end portion 188 of the ice tray 102. With reference to FIG. 5, the controller can includes sensors (not shown) for detecting the temperature of the ice tray and for detecting a rotational position of the ice ejector and a timer (not shown) to control a drive mechanism 262 and the ice tray heater 150. A cover 264 and a support 266 of the controller together define a housing for housing the drive mechanism. The drive mechanism is operably coupled to the ice ejector 170 and is configured to reversibly rotate the ice ejector between the closed position and the ice harvesting position. The drive mechanism includes a reversible motor 272 and a coupler 274 operably engaged with the reversible motor. The motor can be a stepper motor. The coupler includes an opening (not shown) for receiving a shaft 280 which extends outwardly from the axle 172 of the ice ejector. A longitudinally axis of the shaft 280 is generally concentric with the axis of rotation defined by the axle. The controller 260 is configured to control the rotational movement of the motor 272 by starting, stopping and reversing the direction of the motor. The controller controls the motor 272 to rotate the ice ejector 170 from the closed position to the ice harvesting position and the second cover 202 from the closed position to the third position. The controller also automatically provides for refilling the ice tray 102 with water for ice formation after ice is harvested through actuation of a water valve (not shown) connected to a water source (not shown) and delivering water to the ice tray through an inlet structure (not shown).

Figure 7:
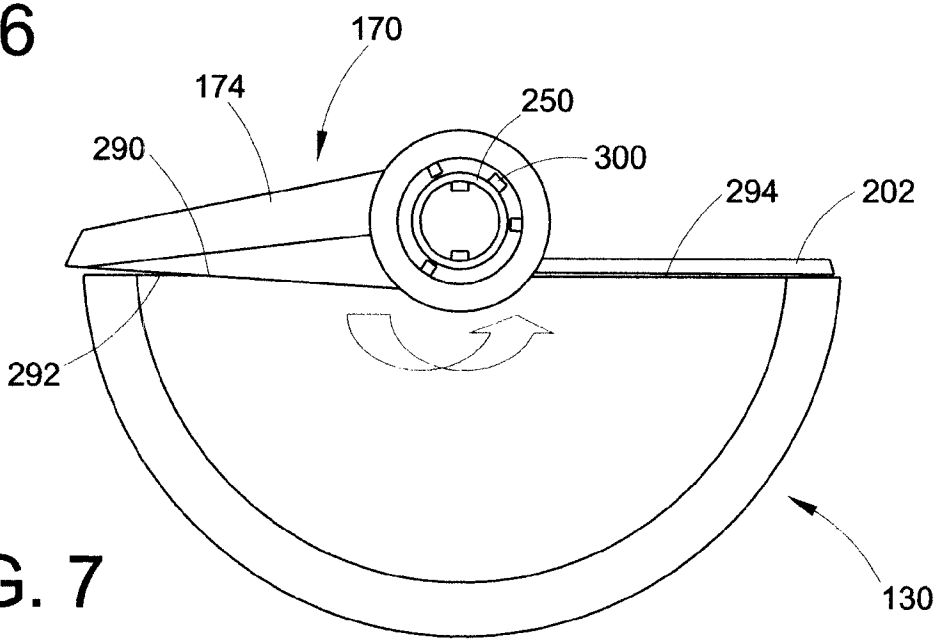
FIG. 7 is a side elevational view of the components of FIG. 6 in a first closed position.

As shown in FIGS. 3 and 7, in the closed first position, the ejector members 174 extend from the ice ejector 170 in a first direction and are at least partially disposed beneath the first cover 200 and are generally opposed to the second cover 202. The second moving cover 202 extends from the ice ejector in a second opposite direction, and is at least partially disposed over the back portion 220 of the ice tray 102. Once ice 130 is formed in each ice forming compartment 104, the controller actuates the heater 150 to heat the ice tray 102 to expand the ice tray and melt a small amount of the ice adjacent the walls of each ice forming compartment. The melting of a portion of the ice provides a lubrication layer between the ice 130 and the walls of the ice forming compartments 104. The lubrication layer and the expansion reduces a torque which the ejector members 174 must exert on the ice to induce the ice to move along the ejection path of movement and be ejected from the ice tray 102.

Once the ice 130 is ready for ejection, the controller actuates the drive mechanism 262. Rotation of an output shaft (not shown) of the motor 272 is transferred through a drive train (not shown) and the coupler 274 to induce rotation of the ice ejector 170 about its longitudinal axis in the direction of the arrow shown in FIGS. 7 and 8. A front face 290 of each ejector member 174 contacts the ice formed in its associated ice forming compartment 104. The front face of each ejector member exerts a force driving an end 292 of the ice 130 downwardly along the arcuate bottom surface 114 of the ice forming compartment 104 as shown in FIG. 4. As the ice is driven downwardly along the arcuate bottom surface, an opposing end 294 of the ice moves upwardly along the arcuate bottom surface on the inside of the ice tray 102. As shown in FIGS. 8-11, the ice engages the second moving cover 202 to rotate the second cover along with the ice ejector 170. As the ice ejector continues to rotate through the ice tray, the ice continues to move the second cover along the axis of rotation defined by the axle of the ice ejector.

Figure 9:
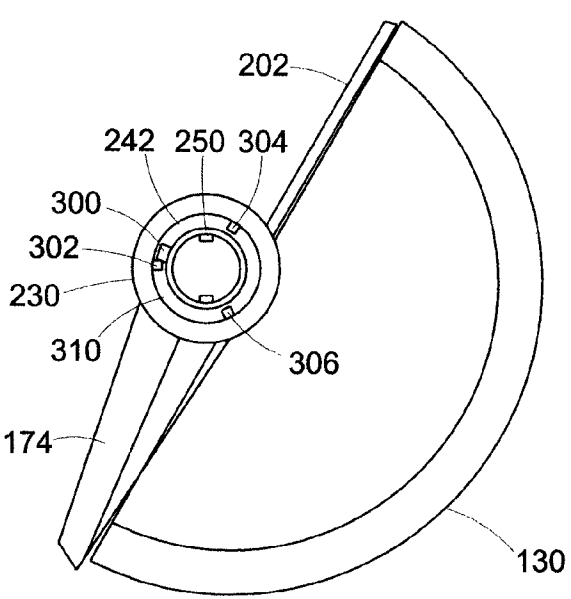
FIGS. 8-13 are side elevational views illustrating movement of the components of FIG. 6 in a first direction.
Figure 8:
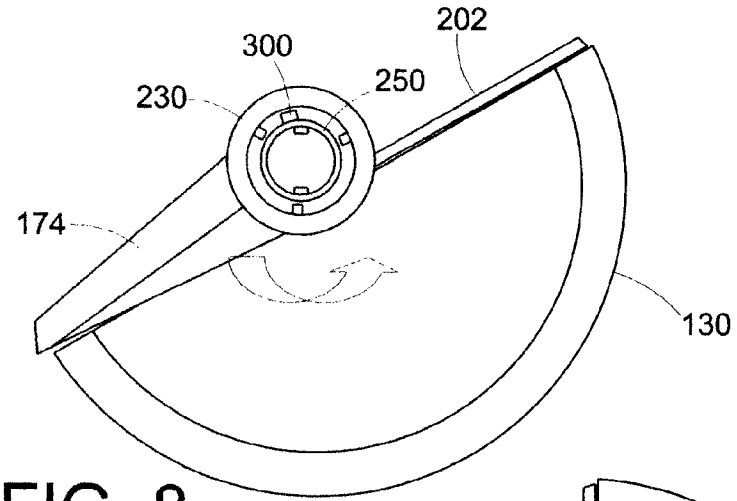
Figure 10:
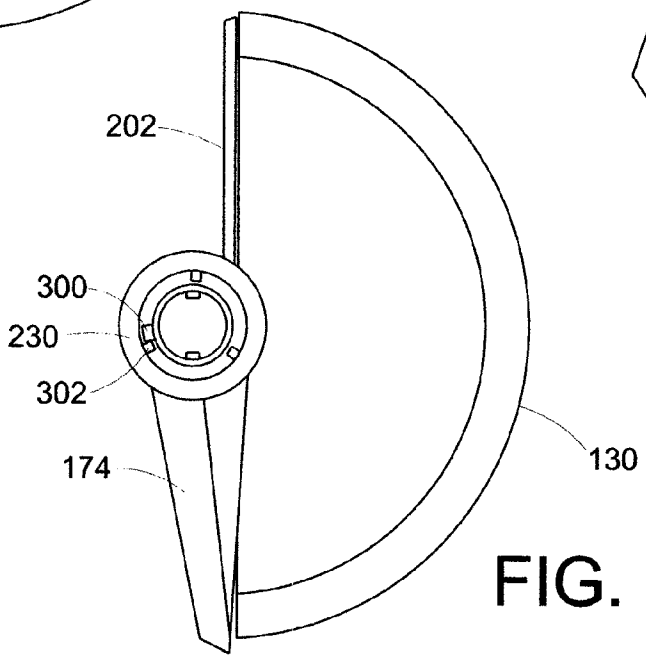
Figure 11:
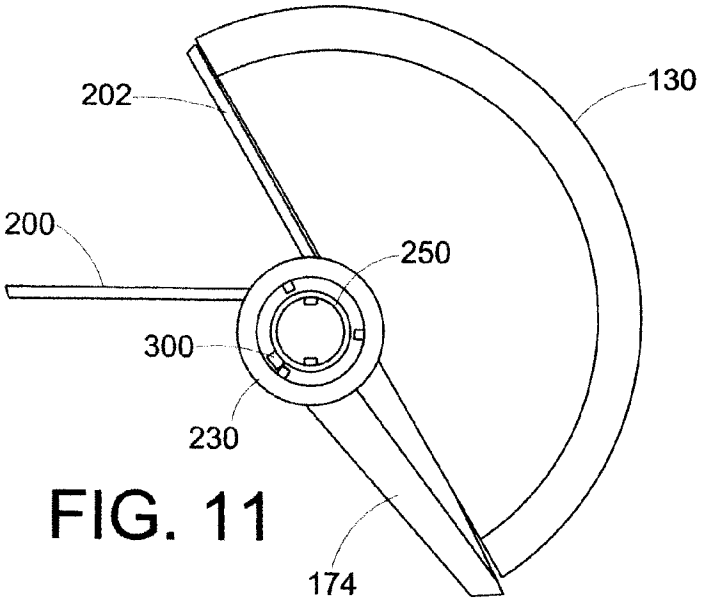
Figure 19:
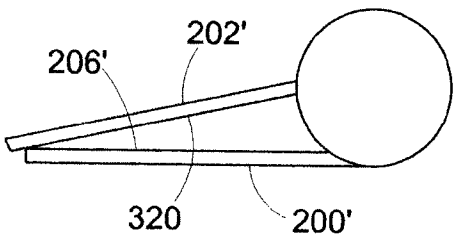
FIG. 19 is a schematic of an alternative position of the second cover relative to the first cover in the third position.

As the ice leaves the ice tray 102, the cam 250 engages the second cover 202 which in turn causes the second cover to rotate with the ice ejector 170 to the third position. Particularly, as shown in FIGS. 9-11, the cam 250 includes an engagement member 300 and the circular flange 230 of the second cover includes spaced apart tabs 302, 304, 306 which extend inwardly from a surface 310 of the opening 242. In the closed first position, the cam engagement member 300 is located between two of the tabs. As the ice ejector 170 rotates to about 90° (FIG. 10), the engagement member contacts one of the tabs. The cam continues to engage the circular flange until rotation of the ice ejector to about a 120° rotational position (FIG. 11). At this rotational position, the cam can disengage the circular flange and the second cover moves into the third position onto the first cover 200. Although, it should be appreciated that the cam 250 can disengage the second cover 202 at the third position. As shown in FIG. 12, in the third position, an edge of the second cover can abut the top surface 206 of the fixed first cover 200 thereby defining an acute angle between the first and second covers. In this third position, the second cover 202 acts as an ice slide for the ice 130 being ejected from the icemaker 100. Alternatively, as shown in FIG. 19, a bottom surface 320 of the second cover 202' contacts the top surface 206' of the first cover 200' such that an edge of the second covers extends past the first cover and the first cover is disposed beneath the second cover.

Figure 13:
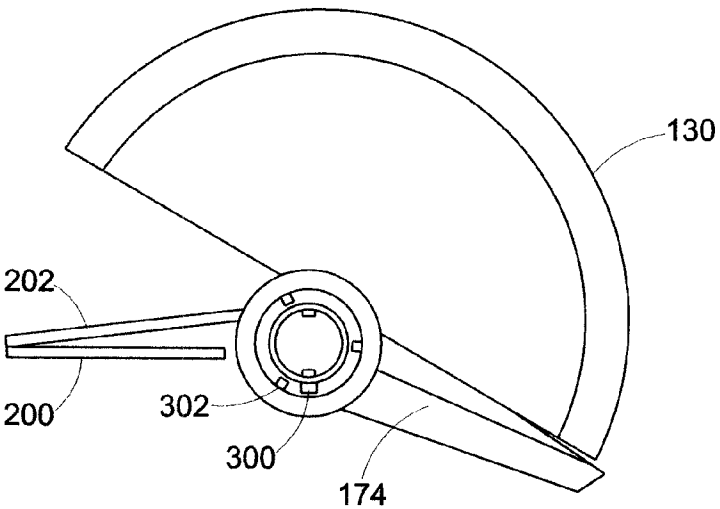
Figure 14:
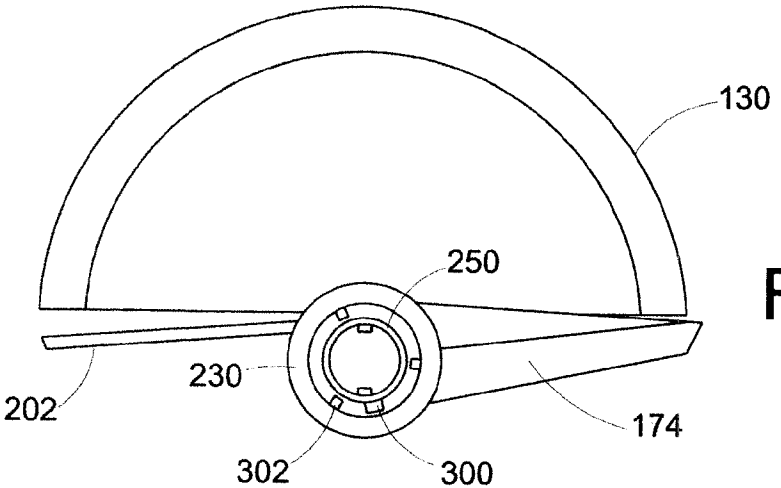
FIG. 14 is a side elevational view of the components of FIG. 6 in a third position.
Figure 15:
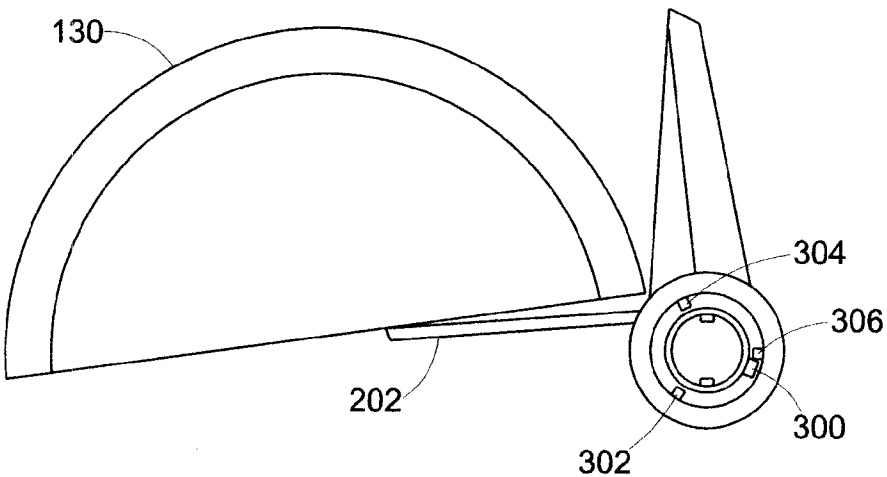
FIG. 15 is a side elevational view of the components of FIG. 6 in a second, ice harvesting position.

The second cover 202 is in the third position after an approximate 180° rotation (FIGS. 12-14). Because the cam 250 is configured to disengage the second cover at or near the third position, the ice ejector 170 is allowed to continue its rotation to the second ice harvesting position. As shown in FIG. 15, at about a 270° rotational position of the ice ejector 170, the ice ejector is in the second, ice harvesting position and the ice 130 begins to slide off the second cover 202 downwardly into an ice bin (not shown) located below the ice tray 102. Although, it should be appreciated that the ice can slide off the second cover before the ice ejector reaches the second position. Continued rotation of the ice ejector 170 in the first direction (indicated by arrows shown in FIGS. 7 and 8) is stopped at the ice harvesting position wherein the ejector members 174 are generally perpendicular the first and second covers.

Figure 17:
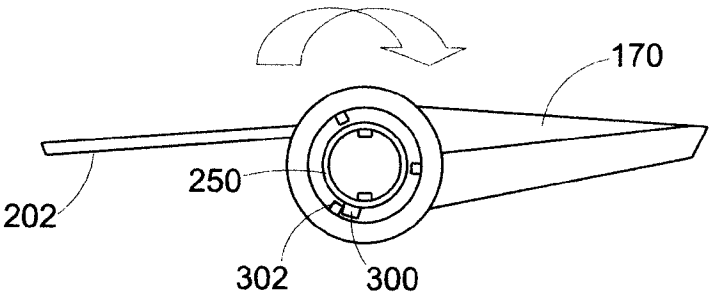
FIGS. 16-18 are side elevational views illustrating movement of the components of FIG. 6 in a second direction.
Figure 18:
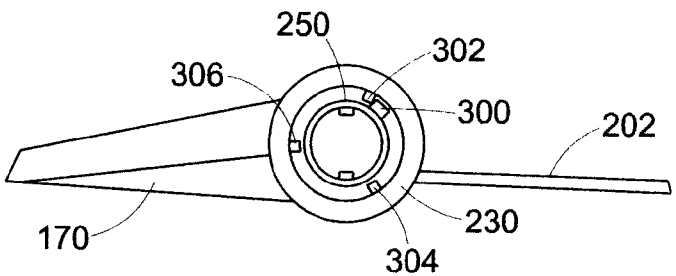
Figure 16:
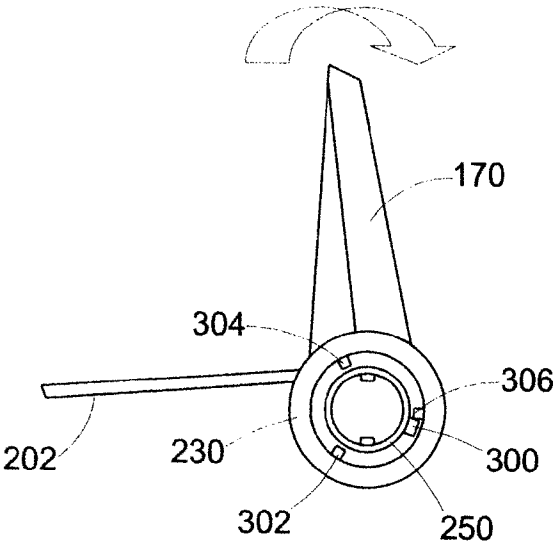

After the ice 130 is ejected, the controller 260 actuates the drive mechanism 262 to induce rotation of the ice ejector 170 about its longitudinal axis in the reverse direction indicated by the arrow shown in FIGS. 16 and 17. As shown in FIG. 17, as the ice ejector 170 rotates to about the 180° rotational position, the cam 250 again engages the second cover 202 to move the second cover with the ice ejector. At about a 30° rotational position, the cam 250 can release the second cover such that the second cover freely moves to the closed position. Although, it should be appreciated that the cam can be configured to release the second cover at the closed position. The ice ejector 170 continues to rotate to the closed position. Again, at the closed position (FIG. 18), the ejector members 174 of the ice ejector are disposed beneath the first cover 200 and the second cover 202 is at least partially disposed over the back portion 220 of the ice forming compartments 104. As the ice ejector is reversibly rotated back to the closed position, the ice forming compartments 104 are being filled with water. However, and as indicated above, the positioning of the first cover 200 and the second cover 202 over the respective front and back portions of the ice forming compartments prevent sloshing of the water as the ice ejector moves therethrough.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An icemaker comprising:

a body including an ice mold for receiving water and freezing water to ice, the ice mold having a first side surface, a second side surface, and an arcuate bottom surface interposed between the first side surface and the second side surface;

an ice ejector including an ejector member rotatably connected to the body, the ice ejector defining an axis of rotation;

a drive mechanism operably coupled to the ice ejector, the drive mechanism configured to reversibly rotate the ice ejector between a first position and a second position;

a first cover fixedly connected to the body for at least partially covering a front portion of the ice mold;

a second cover connected to and extending from the ice ejector, the second cover configured to reversibly rotate with the ice ejector between the first position and a third position, the second cover at least partially covering a back portion of the ice mold at the first position, wherein the first and second covers prevent water slosh in the ice mold, a buildup of frost on the surfaces of the ice mold, water evaporation and ice sublimation, and wherein at the third position the second cover at least partially abuts the first cover, the first cover and the second cover defining an acute angle thereby allowing the ice to slide off the second cover.

2. The icemaker of claim 1, wherein at the first position the ejector member extends from the ice ejector in a first direction and the second cover extends from the ice ejector in a second opposite direction, wherein at the third position the ejector member extends from the ice ejector in the second direction and the second cover extends from the ice ejector in the first direction.

3. The icemaker of claim 1, wherein at the first position the ejector member is at least partially disposed under the first cover, wherein at the second position the ejector member is generally perpendicular to the first cover.

4. The icemaker of claim 1, further comprising a cam mounted to the ice ejector for rotation therewith, the cam being configured to engage the second cover during rotation of the ice ejector to the second position and disengage the second cover as the second cover approaches the third position.

5. The icemaker of claim 1, wherein ice ejector rotates approximately 270° between the first and second positions and the second cover rotates approximately 180° between the first and third positions.

6. An icemaker comprising:

an ice tray including an ice forming compartment for receiving water and freezing the water to ice;

a first cover fixedly connected to the ice tray, the first cover being at least partially disposed over a first portion of the ice forming compartment;

an ice ejector including an ejector member, the ice ejector being rotatable relative to the ice tray from a closed first position to a second ice harvesting position and back to the closed position; and a second cover connected to and extending from the ice ejector, the second cover being configured to at least partially rotate with the ice ejector from the closed position to a third position and back to the closed position, wherein rotation of the ice ejector causes the ejector member to advance into the ice forming compartment whereby ice located in the compartment is urged in an ejection path of movement out of the compartment, the ejection path configured over said first cover and said second cover.

7. The icemaker of claim 6, wherein at the closed position the second cover is at least partially disposed over a second portion of the ice forming compartment, wherein at the third position the second cover at least partially overlies the first cover.

8. The icemaker of claim 7, wherein at the closed position the ejector member is at least partially disposed under the first cover, and generally opposed to the second cover.

9. The icemaker of claim 6, wherein the ice harvesting position is angularly offset from the third position by approximately 90°.

10. The icemaker of claim 6, further comprising a drive mechanism including a reversible motor and a coupler operably engaged with the reversible motor, the coupler being operably connected to the ice ejector.

11. The icemaker of claim 1, further comprising a cam mounted to the ice ejector for rotation with the ice ejector, the cam being configured to engage the second cover.

12. The icemaker of claim 11, wherein the cam releasably attaches the second cover to the ice ejector.

13. The icemaker of claim 6, wherein the first cover defines a first plane and the second cover defines a second plane whereby at the third position the second plane is oriented at an acute angle relative to the first plane thereby allowing the ice to slide off the icemaker.

14. The icemaker of claim 6, wherein the first cover includes a rectilinear top surface.

15. The icemaker of claim 6, wherein the second cover is generally rectangular in shape.

16. An icemaker comprising:

an ice tray including a plurality of ice forming compartments for receiving water and freezing the water to ice;

a fixed cover connected to the ice tray, the fixed cover being at least partially disposed over a front portion of the plurality of ice forming compartments;

an ice ejector moveably connected to the ice tray, the ice ejector including an axle and a plurality of spaced projections located in a common plane tangent to the axle, one projection for each compartment;

a moving cover connected to the ice ejector along a shared axis; and a drive mechanism operably coupled to the ice ejector, the drive mechanism configured to reversibly rotate the ice ejector between a closed position and an ice harvesting position, wherein rotation of the ice ejector causes the plurality of projections to advance into the plurality of ice forming compartments whereby ice located in the plurality of compartments is urged in an arcuate ejection path of movement out of the plurality of compartments, wherein movement of the ice causes the moving cover to rotate about the axle of the ice ejector, wherein as the ice moves out of the plurality of compartments, the ice ejector engages the moving cover whereby the moving cover rotates with the ice ejector to a third position, wherein at the third position the ice ejector disengages the moving cover and continues to rotate to the ice harvesting position.

17. The icemaker of claim 16, wherein at the closed position the moving cover is at least partially disposed over a back portion of the plurality of ice forming compartments, wherein at the closed position the fixed and moving covers are configured to prevent water sloshing, water evaporation and ice sublimation, and frost buildup within the plurality of ice forming compartments.

18. The icemaker of claim 16, wherein at the third position the moving cover at least partially abuts the fixed cover.

19. The icemaker of claim 16, further comprising a cam mounted to the ice ejector for rotation therewith, the cam being configured to engage the moving cover during rotation of the of the ice ejector to the ice harvesting position and disengage the moving cover near the third position.

20. An icemaker comprising:

a body including an ice mold for receiving water and freezing water to ice, the ice mold having a first side surface, a second side surface, and an arcuate bottom surface interposed between the first side surface and the second side surface;

an ice ejector including an ejector member rotatably connected to the body, the ice ejector defining an axis of rotation;

a drive mechanism operably coupled to the ice ejector, the drive mechanism configured to reversibly rotate the ice ejector between a first position and a second position;

a first cover fixedly connected to the body for at least partially covering a front portion of the ice mold;

a second cover connected to and extending from the ice ejector, the second cover configured to reversibly rotate with the ice ejector between the first position and a third position, the second cover at least partially covering a back portion of the ice mold at the first position, wherein the first and second covers prevent water slosh in the ice mold, a buildup of frost on the surfaces of the ice mold, water evaporation and ice sublimation, and wherein at the first position the ejector member extends from the ice ejector in a first direction and the second cover extends from the ice ejector in a second opposite direction, and wherein a cam is mounted to the ice ejector for rotation therewith, the cam being configured to engage the second cover during rotation of the ice ejector to the second position and disengage the second cover as the second cover approaches the third position.

21. An icemaker comprising:

a body including an ice mold for receiving water and freezing water to ice, the ice mold having a first side surface, a second side surface, and an arcuate bottom surface interposed between the first side surface and the second side surface;

an ice ejector including an ejector member rotatably connected to the body, the ice ejector defining an axis of rotation;

a drive mechanism operably coupled to the ice ejector, the drive mechanism configured to reversibly rotate the ice ejector between a first position and a second position;

a first cover fixedly connected to the body for at least partially covering a front portion of the ice mold;

a second cover connected to and extending from the ice ejector, the second cover configured to reversibly rotate with the ice ejector between the first position and a third position, the second cover at least partially covering a back portion of the ice mold at the first position, wherein the first and second covers prevent water slosh in the ice mold, a buildup of frost on the surfaces of the ice mold, water evaporation and ice sublimation, and wherein at the third position the ejector member extends from the ice ejector in the second direction and the second cover extends from the ice ejector in the first direction, and wherein the ice ejector rotates approximately 270° between the first and second positions and the second cover rotates approximately 180° between the first and third positions.

* * * * *